US006540115B1

(12) United States Patent
Sago

(10) Patent No.: US 6,540,115 B1
(45) Date of Patent: Apr. 1, 2003

(54) SEASONING CONTAINER

(75) Inventor: Sigeharu Sago, 353-381, 12-chome, Ichinokuracho, Tajimi-shi Gifu-ken (JP)

(73) Assignees: Mituteru Watanabe, Gifu (JP); Sigeharu Sago, Gifu (JP)

( * ) Notice: Subject to any disclaimer, the term of this patent is extended or adjusted under 35 U.S.C. 154(b) by 0 days.

(21) Appl. No.: 09/988,154

(22) Filed: Nov. 19, 2001

(51) Int. Cl.[7] ..... B67D 5/06
(52) U.S. Cl. ..... 222/185.1; 222/321.6
(58) Field of Search ..... 222/185.1, 184, 222/189.11, 383.1, 186, 321.6

(56) References Cited

U.S. PATENT DOCUMENTS 572,362 A * 12/1896 Loryea ..... 222/184
1,793,492 A * 2/1931 Kreidel ..... 222/321.6
1,865,914 A * 7/1932 Jaden ..... 222/321.6
1,936,906 A * 11/1933 Green ..... 221/78
2,110,252 A * 3/1938 Wolcott ..... 221/105
2,571,083 A * 10/1951 Wilt ..... 222/184
2,630,246 A * 3/1953 Gilmore ..... 222/142.6
2,821,048 A * 1/1958 Efford et al. ..... 47/1
3,346,194 A * 10/1967 Enblom ..... 239/333
4,087,022 A * 5/1978 Zanetti-Streccia ..... 222/183
4,691,847 A * 9/1987 Ford et al. ..... 222/259
6,073,533 A * 6/2000 Brandon ..... 86/45
6,367,714 B1 * 4/2002 Smoot ..... 239/288.5
6,422,434 B1 * 7/2002 Lammond Wass et al. . 222/571
6,439,435 B2 * 8/2002 Rosenberg ..... 222/162

FOREIGN PATENT DOCUMENTS

FR 2645835 A1 * 10/1990 ..... B65D/47/34

* cited by examiner

*Primary Examiner*—Henry C. Yuen
*Assistant Examiner*—Frederick C. Nicolas
(74) *Attorney, Agent, or Firm*—Birch, Stewart, Kolasch & Birch, LLP

(57) ABSTRACT

A seasoning container comprising a container main body having an upper opening portion and a lower opening portion, an upper lid having a recessed portion and detachably fitted to the upper opening portion, a bottom lid detachably fitted to the lower opening portion of the container main body and having a nozzle disposed at a central area thereof, a control member whose upper end is connected to an inner central area of a handle which can be lowered into the recess of the upper lid, a pump member placed within a lower space portion disposed on an extension of the control member and communicated with an interior of the container main body, and a narrow tubular member, which is passed through a central through hole portion of the pump material, being in communication with the nozzle of the bottom lid, thereby jetting the liquid seasoning through a container main body bottom surface portion.

3 Claims, 4 Drawing Sheets

SEASONING CONTAINER

BACKGROUND OF THE INVENTION

1. Field of the Invention

This invention relates to a seasoning container.

2. Related Art

Since a typical conventional container containing liquid seasoning such as soy sauce, sauce, oil or the like is constructed such that the liquid content is poured from a top lid portion thereof irrespective of the kind of material from which the container is made, it is an ordinary practice to incline a container main body 90 or more degrees by a hand when in use.

With this construction, however, when the container is inclined for pouring, the liquid seasoning often leaks or spills. In the worst case, the upper lid comes off. This is inconvenient for the user, indeed.

The present invention has been accomplished in view of the above inconvenience.

SUMMARY OF THE INVENTION

It is, therefore, an object of the present invention to provide a seasoning container which is accomplished based on a drastic idea (i.e., pouring the content from the bottom instead of from the top) completely breaking common sense and which is capable of obviating the above-mentioned inconvenience inherent in the conventional seasoning containers.

To achieve the above object, there is provided a seasoning container comprising a container main body having an upper opening portion and a lower opening portion, an upper lid having a recessed portion and detachably fitted to the upper opening portion, a bottom lid detachably fitted to the lower opening portion of the container main body and having a nozzle disposed at a central area thereof, a control member whose upper end is connected to an inner central area of a handle which can be lowered into the recess of the upper lid, a pump member placed within a lower space portion disposed on an extension of the control member and communicated with an interior of the container main body, and a narrow tubular member, which is passed through a central through hole portion of the pump material, being in communication with the nozzle of the bottom lid, thereby jetting the liquid seasoning through a container main body bottom surface portion.

To pour the liquid content such as soy sauce, sauce, oil or the like, the handle at the center of the upper end of the container main body is depressed by a finger. Then, the internal control member presses the pump member, which is placed within a lower space portion disposed on an extension thereof, to force the liquid seasoning contained in the container main body to flow down through the narrow tubular member. Finally, the liquid seasoning is jetted in the form of mist through the center nozzle of the bottom lid.

DETAILED DESCRIPTION OF THE EMBODIMENT

Figure 1:
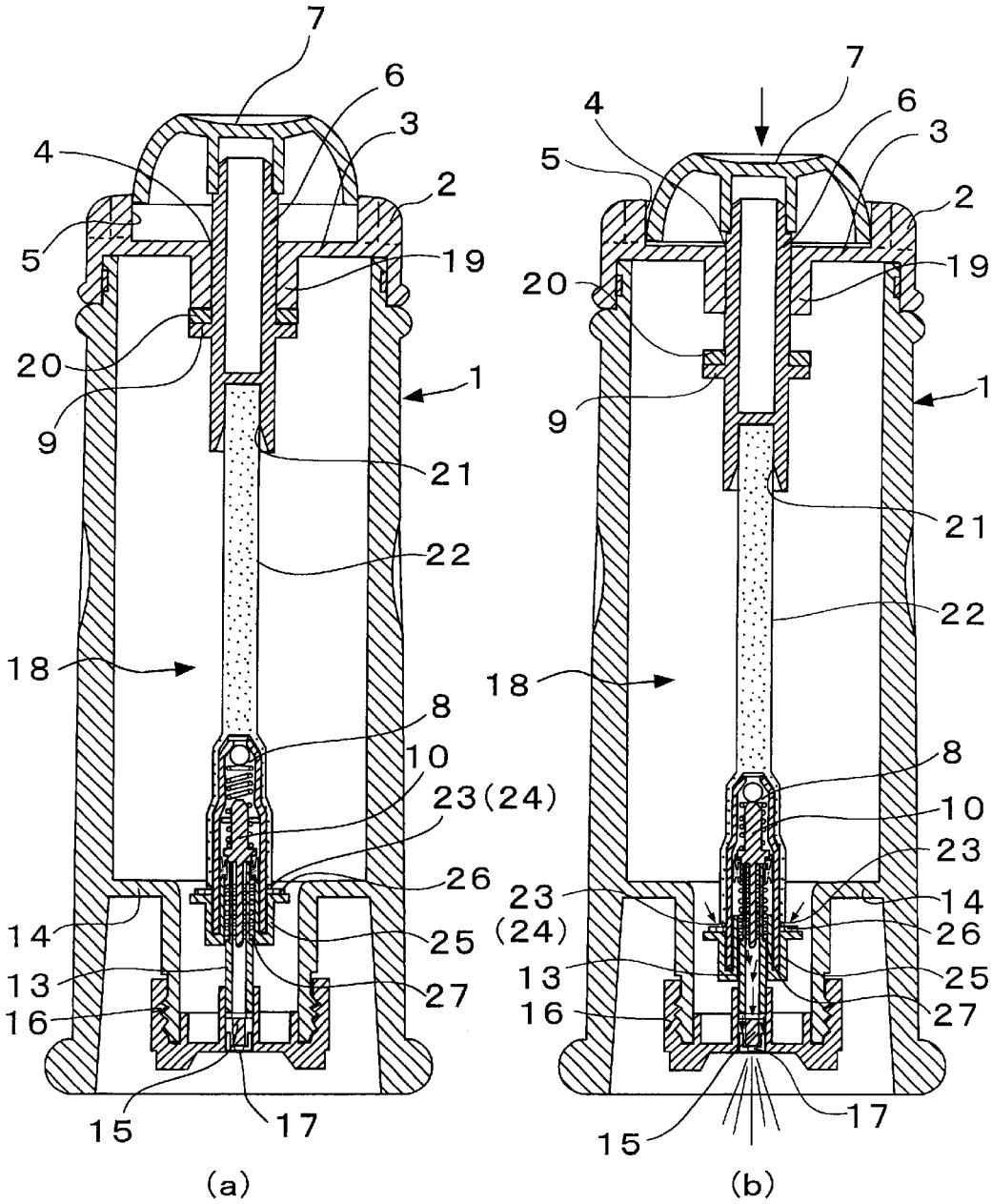
FIG. 1 is an overall front sectional view, FIG. 1(*a*) is a front sectional view when not in use and FIG. 1(*b*) is a front sectional view when in use.
Figure 2:
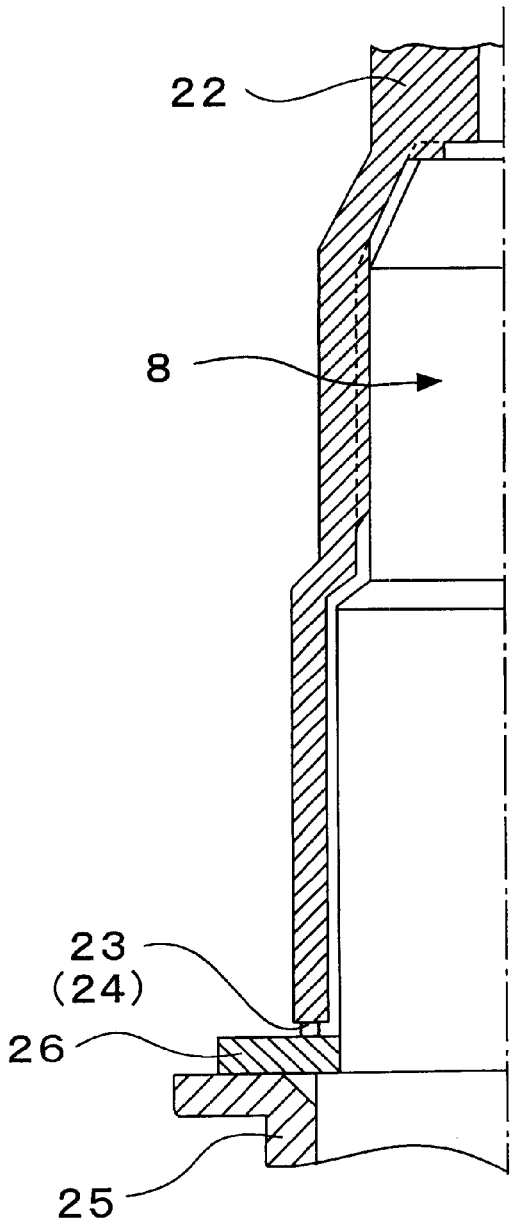
FIG. 2 is an enlarged front sectional view of an important portion of FIG. 1.

Reference numeral 1 generally denotes a container main body whose upper and lower end portions are open. An upper lid 2 is fitted to an upper end portion of the container main body 1. The upper lid 2 has a lid plate 3 with a central through hole 4 formed in a central area of the lid plate 3. A recessed portion 5 is formed in an upper surface portion of the lid plate 3.

The upper lid 2 is provided at the recessed portion 5 with a handle 7. An upper end portion of the control member 6 inserted through the through hole 4 of the lid plate 3 is threadingly fixed to a central area of a back portion of the handle 7.

A peripheral wall 19 is integral with a lower side of the central through hole 4 of the lid plate 3. The control member 6 is slidingly moved guided by a surface of the peripheral wall 19.

The control member 6 is provided with a stopper 9 projecting from an appropriate intermediate area thereof. A packing 20 is disposed on an upper surface portion of this stopper 9. The bottom surface portion of the peripheral wall 19 of the through hole 4 is brought into contact with and brought away from the packing 20.

An opening portion 21 is formed in a lower end portion of the control member 6. An upper end portion of a connecting rod 22 is removably fitted to this opening portion 21. A lower space portion 8 is formed on a lower extension of the connecting rod 22.

A pump member 10 of an arbitrary mechanism is installed in the lower space portion 8 of the connecting rod 22.

An irregular portion 24, which is composed of a plurality of concave grooves 23 spacedly arranged, is formed on a peripheral bottom surface portion of the lower space portion 8 of the connecting rod 22.

A lower lid 25 is fitted to the bottom surface portion of the lower space portion 8 in which the pump member 10 is received. A packing 26 is attached to the periphery of the upper surface portion of the lower lid 25. The irregular portion 24 at the bottom surface of the periphery of the connecting rod 21 is abutted with the packing 26.

Figure 3:
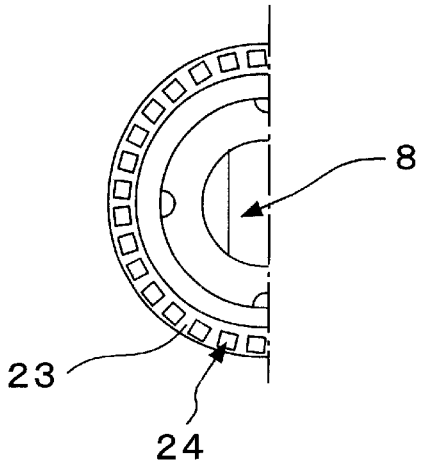
FIG. 3 is a bottom view of an important portion of FIG. 1.
Figure 4:
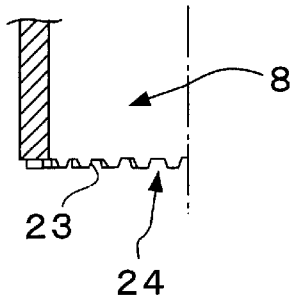
FIG. 4 is a front sectional view of FIG. 3.
Figure 5:
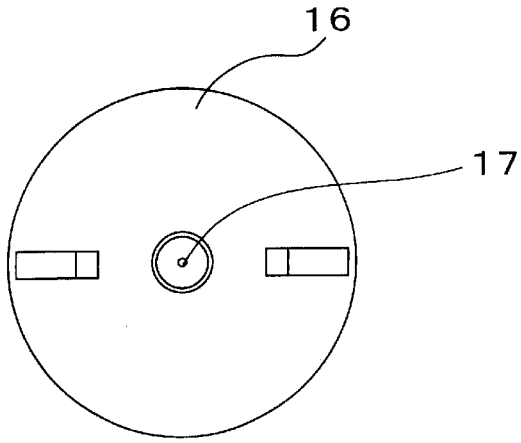
FIG. 5 is an overall bottom view of FIG. 1.

As shown in FIGS. 3 and 4, the small concave grooves 23 composing the irregular portion 24 serves as a strainer for the liquid seasoning which flows into the lower space portion 8, that is a pump chamber, from an interior 18 of the container main body 1.

A narrow tubular member 13, which is in communication with the lower space portion 8 that is the pump chamber, is inserted into a through hole 27 formed in a central area of the lower lid 25. This narrow tubular member 13 is connected to a central opening portion 15 of the bottom lid 16 fitted to the bottom surface portion 14 of the container main body 1.

A nozzle 17 serving as an ejection port is mounted, in an airtight fashion, on an outlet of the central opening portion 15 of the bottom lid 16. The narrow tubular member 13 is communicated with this nozzle 17.

Figure 6:
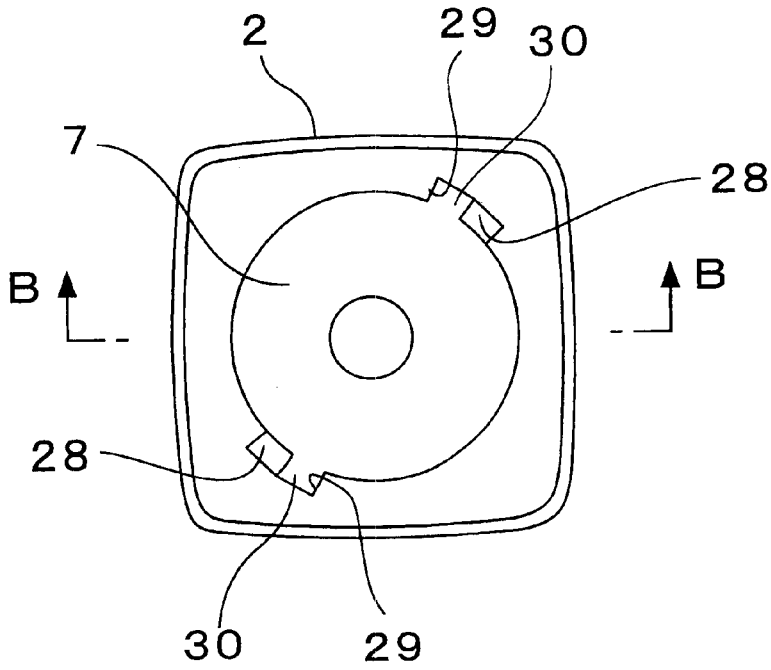
FIG. 6 is an overall plan view of FIG. 1.
Figure 7:
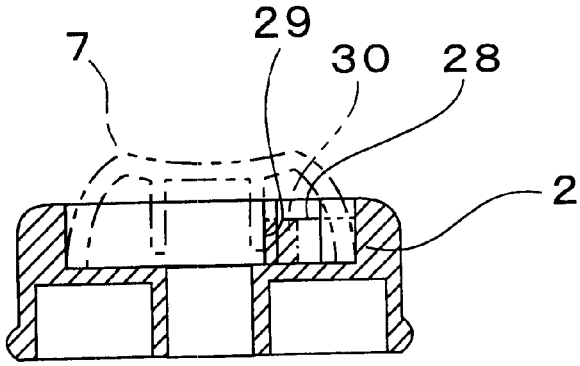
FIG. 7 is a section view taken on line B—B of FIG. 6.

As shown in FIGS. 6 and 7, the recessed portion 5 of the upper lid upper surface portion is provided at opposing locations of a planar periphery thereof with recessed step portions 28 and concave groove portions 29 adjacent to the recessed step portions 28. When the handle 7 fitted to the recessed portion 5 is turned horizontally, projecting claws 30, which are disposed at opposing locations of a periphery of the handle 7 so as to correspond to the recessed step portions 28 and concave groove portions 29, locks the handle 7 so as not to make an up and down motion when the projecting claws 30 are brought to the recessed step portions 28. When the projecting claws 30 are brought to the concave groove portions 29, they are descended into the concave groove portions 29 together with the handle 7. In that condition, when the handle 7 is moved up and down by a finger, the pump 10 is actuated through the control member 6 and the connecting rod 21.

Since the seasoning container according to the present invention is constructed such that the liquid seasoning such as soy sauce, sauce, oil or the like contained in the container main body is jetted downward from the bottom surface portion of the container main body, the function is entirely different from the conventional comparable containers in which the seasoning is poured from the top by inclining the container main body. Accordingly, any difficulty for pouring the liquid seasoning can be obviated. In addition, no leak nor spill occurs. Thus, the user of the seasoning container can be free from paying his/her utmost care which would otherwise be required when the liquid seasoning is to be poured. As apparent from the foregoing, the seasoning container according to the present invention is a "user friendly product".

What is claimed is:

1. A seasoning container comprising:

a container main body having an upper opening portion and a lower opening portion;

an upper lid having a recessed portion and detachably fitted to said upper opening portion;

a bottom lid detachably fitted to said lower opening portion of said container main body and having a nozzle disposed at a central area thereof;

a control member whose upper end is connected to an inner central area of a handle which can be lowered into said recessed portion of said upper lid;

a pump member placed within a lower space portion disposed on an extension of said control member and communicated with an interior of said container main body; and a narrow tubular member, which is passed through a central through hole portion of said pump member, being in communication with said nozzle of said bottom lid, thereby jetting liquid seasoning through container main body bottom surface portion.

2. A seasoning container comprising:

a container main body having an upper opening portion and a lower opening portion;

an upper lid having a recessed portion and detachably fitted to said upper opening portion;

a bottom lid detachably fitted to said lower opening portion of said container main body and having a nozzle disposed at a central area thereof;

a control member whose upper end is connected to an inner central area of a handle which can be lowered into said recessed portion of said upper lid;

a connecting rod fitted to a lower end opening portion of said control member; a pump member placed within a lower space portion disposed on an extension of said connecting rod;

an irregular portion, which is composed of a plurality of concave grooves spacedly arranged, formed a peripheral bottom surface portion of a lower space portion of said connecting portion and communicated with an interior of said container main body; and a narrow tubular member, which is pierced through a central through hole portion of said pump material, being in communication with said nozzle of said bottom lid, thereby jetting the liquid seasoning through a container main body bottom surface portion.

3. Seasoning container according to claim 1 or 2, wherein said recessed portion of said upper lid upper surface portion is provided at opposing locations of a planar periphery thereof with recessed step portions and concave groove portions adjacent to said recessed step portions, and said handle can be stopped in action or can be pushed down by moving rotary projecting claws disposed at opposing locations of a periphery of said handle so as to correspond to said recessed step portions and concave groove portions.

* * * * *